US010021951B2

(12) United States Patent
Bobillier et al.

(10) Patent No.: US 10,021,951 B2
(45) Date of Patent: Jul. 17, 2018

(54) HAND HELD APPLIANCE

(71) Applicant: Dyson Technology Limited, Wiltshire (GB)

(72) Inventors: Ben Colin Bobillier, Bath (GB); Frederick Anthony Howe, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/297,932

(22) Filed: Oct. 19, 2016

(65) Prior Publication Data

US 2017/0112257 A1 Apr. 27, 2017

(30) Foreign Application Priority Data

Oct. 21, 2015 (GB) ..... 1518643.0

(51) Int. Cl.
*A45D 20/12* (2006.01)

(52) U.S. Cl.
CPC ..... *A45D 20/12* (2013.01); *A45D 2200/202* (2013.01)

(58) Field of Classification Search
CPC .... A45D 20/12; A45D 2200/202; F24H 1/10; H01T 23/00
USPC ..... 34/97–100; 392/384–385
See application file for complete search history.

(56) References Cited

U.S. PATENT DOCUMENTS 2,514,528 A 7/1950 Wahl
3,261,107 A 7/1966 Ponczek et al.
3,439,204 A 4/1969 Ponczek et al.
3,610,881 A 10/1971 Stewart
4,085,309 A 4/1978 Godel et al.
4,260,875 A 4/1981 Walter et al.
4,327,278 A 4/1982 Tomaro
(Continued)

FOREIGN PATENT DOCUMENTS

CN 2819903 9/2006
CN 201011916 1/2008
(Continued)

OTHER PUBLICATIONS

Search Report dated Apr. 19, 2016, directed to GB Application No. 1518643.0; 1 page.
(Continued)

*Primary Examiner* — Stephen M Gravini
(74) *Attorney, Agent, or Firm* — Morrison & Foerster LLP

(57) ABSTRACT

A hairdryer including an ionizing system and a heater wherein the ionizing system comprises an ion producing electrode and the ion producing electrode extends along an external periphery of the heater. The ion producing electrode may extend along the heater to a downstream end of the heater. The ion producing electrode may extend along the heater from an upstream end of the heater. The heater may be generally cylindrical and the ion producing electrode extends along a radially outer surface of the heater. The ion producing electrode may have a first part which extends along a first axis and the first part extends along the external periphery of the heater. The ion producing electrode may have a second part, which extends along a second axis, wherein the second part extends radially inwards from the external periphery of the heater.

17 Claims, 6 Drawing Sheets

(56) References Cited

U.S. PATENT DOCUMENTS

| | | | | |
|---|---|---|---|---|
| 4,395,619 | A | 7/1983 | Harigai | |
| 4,550,358 | A | 10/1985 | Crowley et al. | |
| 4,701,595 | A | 10/1987 | Okutsu et al. | |
| 4,706,153 | A | 11/1987 | Sainomoto et al. | |
| 4,711,988 | A | 12/1987 | Thaler et al. | |
| 4,720,759 | A | 1/1988 | Tabei | |
| 4,721,121 | A | 1/1988 | Adams | |
| 4,767,914 | A | 8/1988 | Glucksman | |
| 5,434,946 | A | 7/1995 | Barzilai et al. | |
| 5,448,677 | A | 9/1995 | Fell et al. | |
| 5,612,849 | A * | 3/1997 | Prehodka | H05F 3/04 310/339 |
| 5,642,570 | A | 7/1997 | Lee | |
| 5,651,190 | A | 7/1997 | Sanders | |
| 5,857,262 | A | 1/1999 | Bonnema et al. | |
| 6,191,930 | B1 * | 2/2001 | Ramchandani | A45D 20/12 361/213 |
| 6,285,828 | B1 | 9/2001 | Cafaro | |
| 6,640,049 | B1 * | 10/2003 | Lee | A45D 20/08 34/96 |
| 6,895,686 | B1 * | 5/2005 | Sabbatini | A45D 20/12 34/96 |
| 7,644,511 | B2 * | 1/2010 | Ishikawa | A45D 20/12 132/220 |
| 7,748,343 | B2 * | 7/2010 | Kim | B05B 5/0255 118/621 |
| 8,015,724 | B2 * | 9/2011 | Imahori | A45D 20/12 118/723 R |
| 8,434,238 | B2 | 5/2013 | Gross et al. | |
| 9,510,395 | B2 | 11/2016 | Coulton et al. | |
| 9,526,310 | B2 * | 12/2016 | Courtney | A45D 20/12 |
| 9,693,616 | B2 | 7/2017 | Sakuma et al. | |
| 9,756,922 | B1 | 9/2017 | Duthe et al. | |
| 2006/0098962 | A1 | 5/2006 | Ceva | |
| 2007/0119069 | A1 | 5/2007 | Shim | |
| 2007/0204477 | A1 | 9/2007 | Lin | |
| 2008/0229606 | A1 | 9/2008 | Hirai | |
| 2010/0162585 | A1 | 7/2010 | Liu et al. | |
| 2010/0286754 | A1 | 11/2010 | Bly | |
| 2012/0126041 | A1 | 5/2012 | Nunomura et al. | |
| 2014/0255173 | A1 | 9/2014 | Poulton et al. | |
| 2015/0007855 | A1 | 1/2015 | Moloney et al. | |
| 2016/0166035 | A1 | 6/2016 | Douglas et al. | |
| 2016/0220004 | A1 | 8/2016 | Moloney et al. | |
| 2017/0006991 | A1 | 1/2017 | Stephens et al. | |
| 2017/0112255 | A1 | 4/2017 | Saunders et al. | |
| 2017/0112256 | A1 * | 4/2017 | Bobillier | A45D 20/12 |
| 2017/0112257 | A1 * | 4/2017 | Bobillier | A45D 20/12 |
| 2017/0112258 | A1 * | 4/2017 | Blanc | A45D 20/12 |
| 2017/0150798 | A1 | 6/2017 | Bobillier et al. | |
| 2017/0164709 | A1 | 6/2017 | Laveni et al. | |

FOREIGN PATENT DOCUMENTS

| | | | | |
|---|---|---|---|---|
| DE | 27 27 940 | 12/1977 | | |
| DE | 198 35 791 | 2/1999 | | |
| EP | 0 518 035 | 12/1992 | | |
| EP | 1 433 401 | 6/2004 | | |
| EP | 1 527 709 | 5/2005 | | |
| EP | 1 836 919 | 9/2007 | | |
| EP | 1 956 317 | 8/2008 | | |
| EP | 2 138 065 | 12/2009 | | |
| EP | 2 161 511 | 3/2010 | | |
| EP | 2 308 337 | 4/2011 | | |
| FR | 1.217.860 | 5/1960 | | |
| GB | 684341 | 12/1952 | | |
| GB | 2 023 351 | 12/1979 | | |
| GB | 2 048 627 | 12/1980 | | |
| GB | 2543537 A * | 4/2017 | | A45D 20/12 |
| IT | 1255589 | 11/1995 | | |
| JP | 51-153187 | 5/1975 | | |
| JP | 60-75007 | 4/1985 | | |
| JP | 61-217648 | 9/1986 | | |
| JP | 1-291059 | 11/1989 | | |
| JP | 2-252405 | 10/1990 | | |
| JP | 3-111002 | 5/1991 | | |
| JP | 4-105603 | 4/1992 | | |
| JP | 4-338406 | 11/1992 | | |
| JP | 5-293010 | 11/1993 | | |
| JP | 6-54713 | 3/1994 | | |
| JP | 6-78826 | 3/1994 | | |
| JP | 7-213330 | 8/1995 | | |
| JP | 7-313239 | 12/1995 | | |
| JP | 8-47415 | 2/1996 | | |
| JP | 8-299048 | 11/1996 | | |
| JP | 11-76390 | 3/1999 | | |
| JP | 3116053 | 11/2005 | | |
| JP | 2006-236707 | 9/2006 | | |
| JP | 3130650 | 4/2007 | | |
| JP | 2016-112424 | 6/2016 | | |
| JP | 2017-18593 | 1/2017 | | |
| JP | 2017-77472 | 4/2017 | | |
| JP | 2017077471 A * | 4/2017 | | A45D 20/12 |
| WO | WO-95/31915 | 11/1995 | | |
| WO | WO-2004/019726 | 3/2004 | | |
| WO | WO-2004/064565 | 8/2004 | | |
| WO | WO 2017068321 A1 * | 4/2017 | | A45D 20/12 |

OTHER PUBLICATIONS

International Search Report and Written Opinion dated Dec. 16, 2016, directed to International Application No. PCT/GB2016/053017; 9 pages.

Bobillier et al., U.S. Office Action dated Sep. 22, 2017, directed to U.S. Appl. No. 15/297,847; 9 pages.

Saunders et al., U.S. Office Action dated Sep. 26, 2017, directed to U.S. Appl. No. 15/297,935; 7 pages.

* cited by examiner

HAND HELD APPLIANCE

REFERENCE TO RELATED APPLICATIONS

This application claims the priority of United Kingdom Application No. 1518643.0, filed Oct. 21, 2015, the entire contents of which are incorporated herein by reference.

FIELD OF THE INVENTION

This invention relates to a handheld appliance and in particular a hair care appliance such as a hairdryer.

BACKGROUND OF THE INVENTION

Generally, a motor and fan are provided which draw fluid into a body; the fluid may be heated prior to exiting the body. The motor is susceptible to damage from foreign objects such as dirt or hair so conventionally a filter is provided at the fluid inlet to the blower. The fan and heater require power in order to function and this is provided via internal wiring from either a mains power cable or batteries attached to the appliance.

Often, a hairdryer is provided with an ioniser. The ioniser is either permanently on or activated by a control switch. Generally the ion generator is located in an air flow so that the ions generated are propelled towards the hair.

SUMMARY OF THE INVENTION

According to a first aspect, the invention provides a hairdryer comprising an ionising system and a heater wherein the ionising system comprises an ion producing electrode and the ion producing electrode extends along an external periphery of the heater.

By routing the ioniser around the external periphery of the heater, the impact of the ioniser on fluid flowing through the heater is minimised.

Preferably, the ion producing electrode extends along the heater to a downstream end of the heater.

It is preferred that the ion producing electrode extends along the heater from an upstream end of the heater.

Preferably, the heater is generally cylindrical and the ion producing electrode extends along a radially outer surface of the heater.

It is preferred that the ion producing electrode has a first part which extends along a first axis and the first part extends along the external periphery of the heater.

Preferably, the ion producing electrode has a second part, which extends along a second axis, wherein the second part extends radially inwards from the external periphery of the heater.

Whilst the majority of the ion producing needle is kept out of the main fluid flow passing through the heater, it is advantageous for ions to be emitted into this flow as the ions are carried to the hair that is being styled or dried.

It is preferred that the second axis is substantially orthogonal to the first axis.

Preferably, the heater is surrounded by a wall and the ion producing electrode extends along an external periphery of the wall.

It is preferred that the ionising system comprises an ion generator and the ion producing electrode comprises a high tension wire which extends from the ion generator.

Preferably, the ion producing electrode comprises a flat conductive needle. This is advantageous when space around the periphery of the heater is limited.

It is preferred that the ionising system comprises an ion generator; and the ion producing electrode comprises a high tension wire which extends from the ion generator, a flat conductive needle, and a connector for connecting the flat conductive needle to the high tension wire.

Preferably, the connector is located at or near an upstream end of the heater.

It is preferred that the heater is surrounded by a wall and the connector is located at or near an upstream end of the wall.

Preferably, the hairdryer further comprises an inner wall adapted to retain a downstream end of the heater in position within the hairdryer wherein the inner wall comprises a recess for accommodating the ion producing electrode. This ensures reliable positioning of the ioniser with respect to the heater and other components within the hairdryer body.

It is preferred that the inner wall comprises an aperture through which the ionising needle projects.

Preferably, the ion producing electrode comprises a first part which extends along a first axis and the first part extends along the external periphery of the heater to the recess in the inner wall.

It is preferred that the ionising needle has a second part, wherein the second part extends through the aperture radially inwards from the external periphery of the heater and inner wall.

Preferably the first part and the second part are formed from a flat conductive needle.

It is preferred that the third part comprises a high tension wire.

BRIEF DESCRIPTION OF THE DRAWINGS

The invention will now be described, by way of example only, with reference to the accompanying drawings, in which.

DETAILED DESCRIPTION OF THE INVENTION

Figure 1:
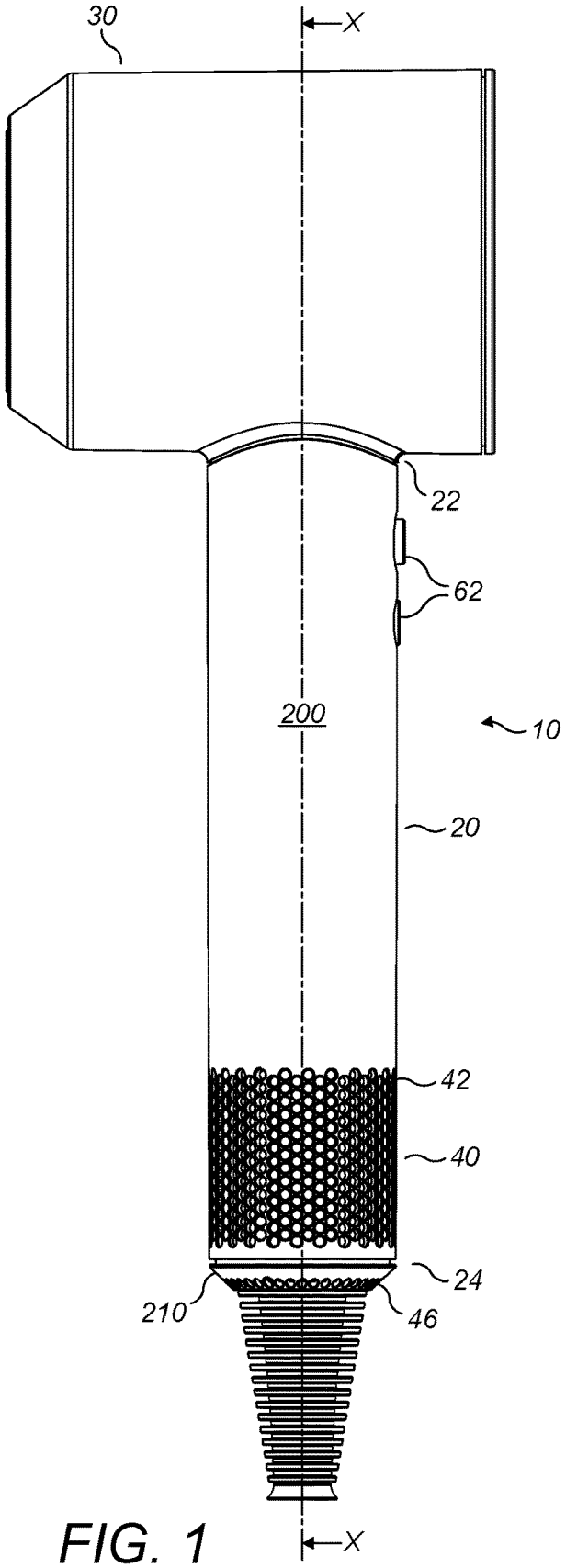
FIG. 1 shows a hairdryer in which a motor mount according to the invention may be used.
Figure 2:
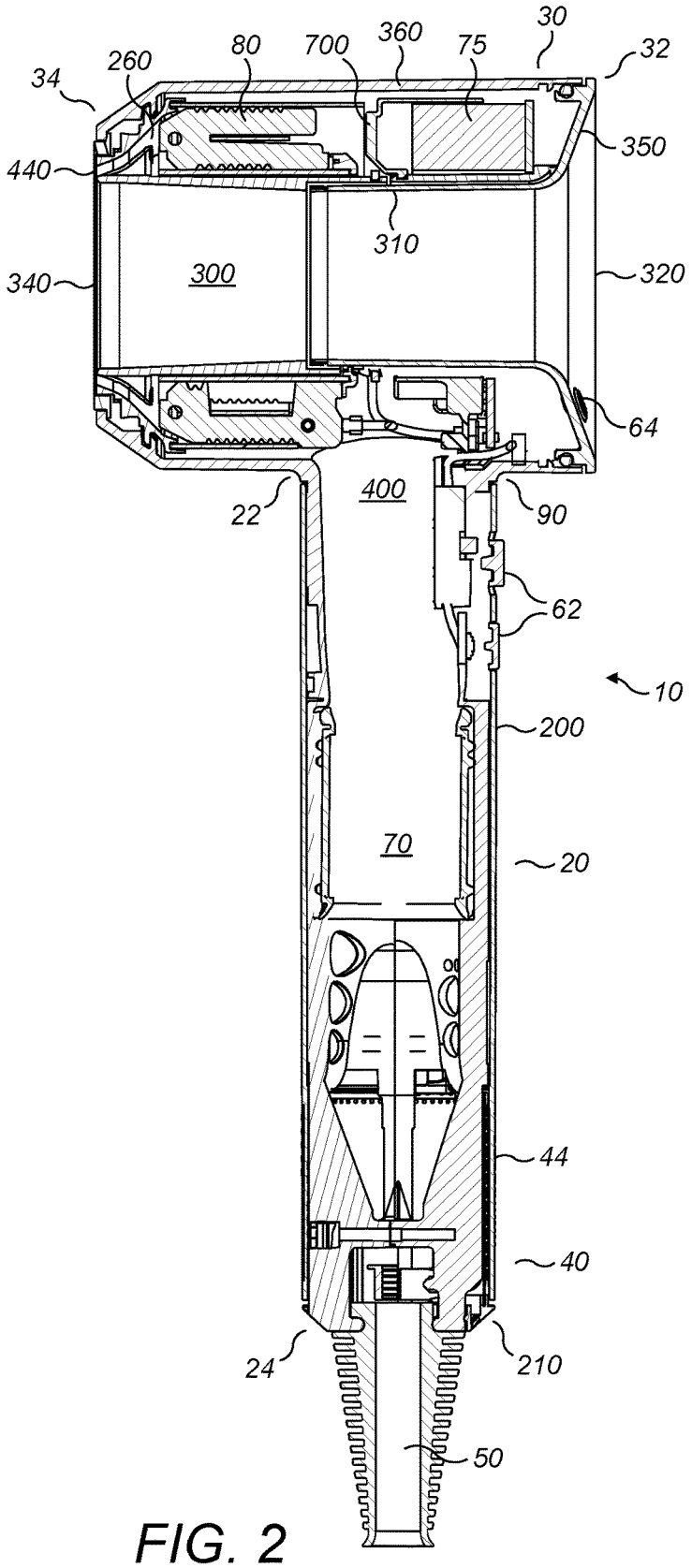
FIG. 2 shows a cross section through the hairdryer of FIG. 1.
Figure 3:
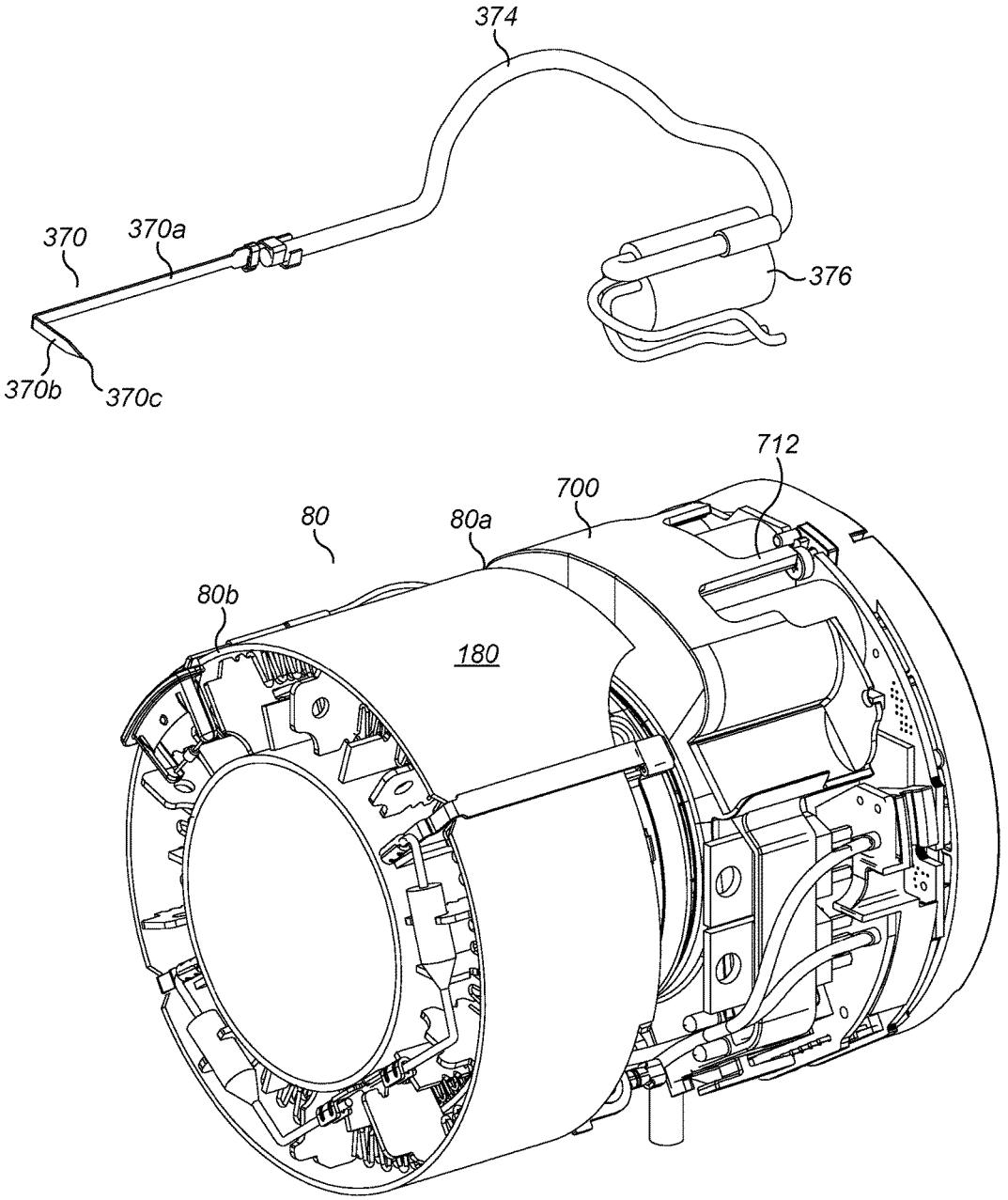
FIG. 3 shows an isometric view of an ionising system according to the invention.
Figure 4:
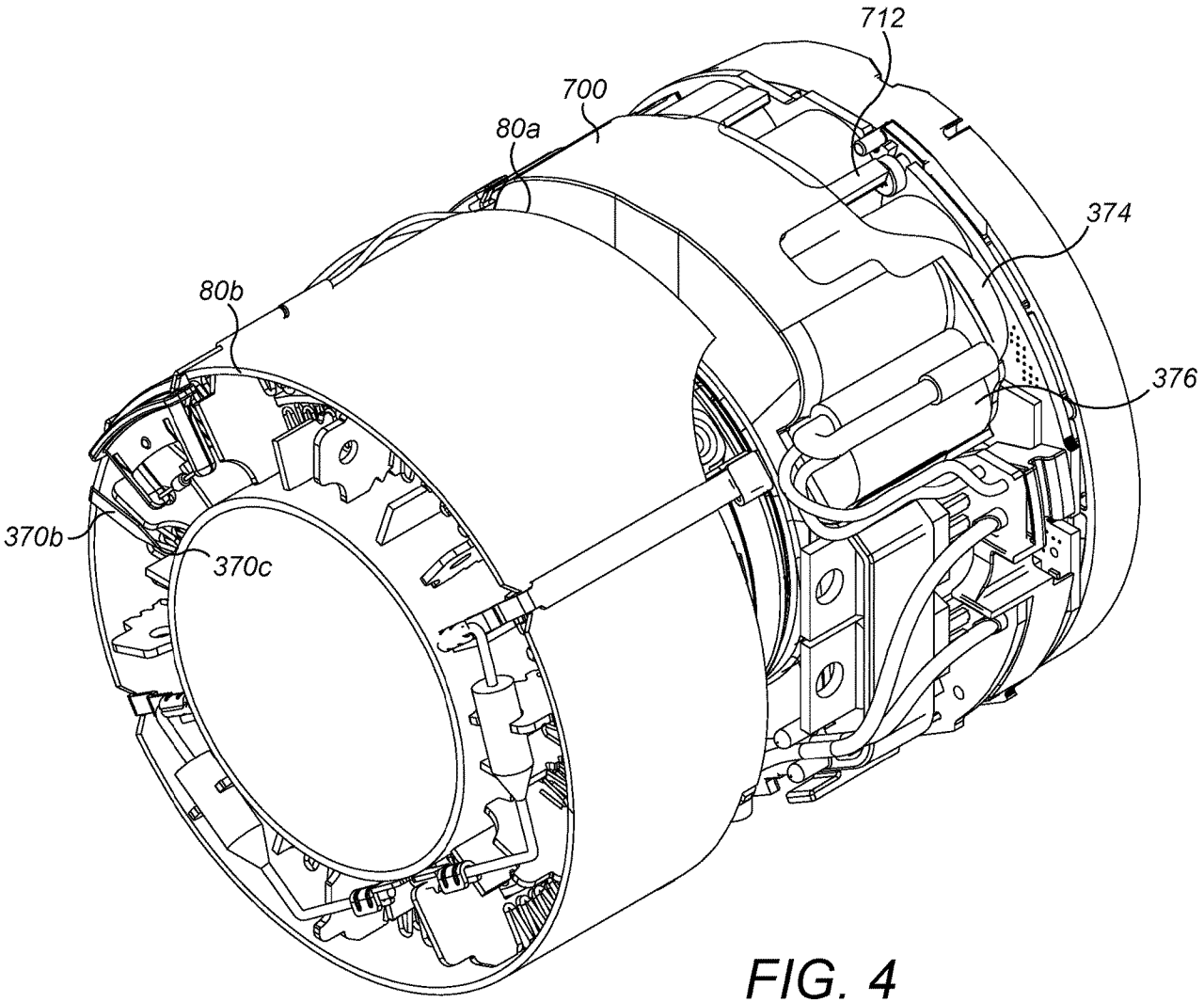
FIG. 4 shows a front isometric view of the ionising system of FIG. 3 in situ with respect to the heater.
Figure 5:
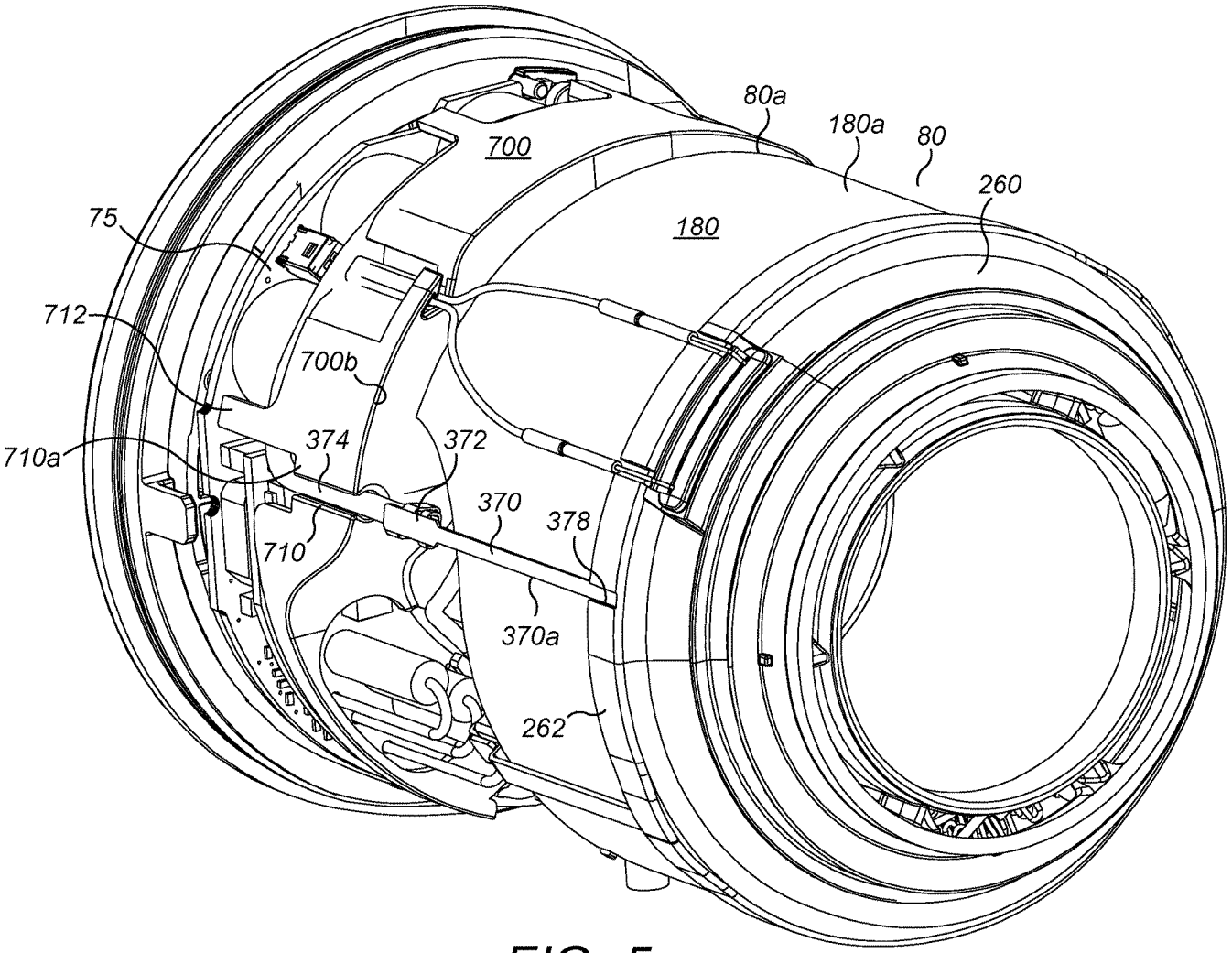
FIG. 5 shows a front isometric view of the ionising system of FIG. 3 in situ with respect to internal components of the hairdryer of FIG. 1.
Figure 6:
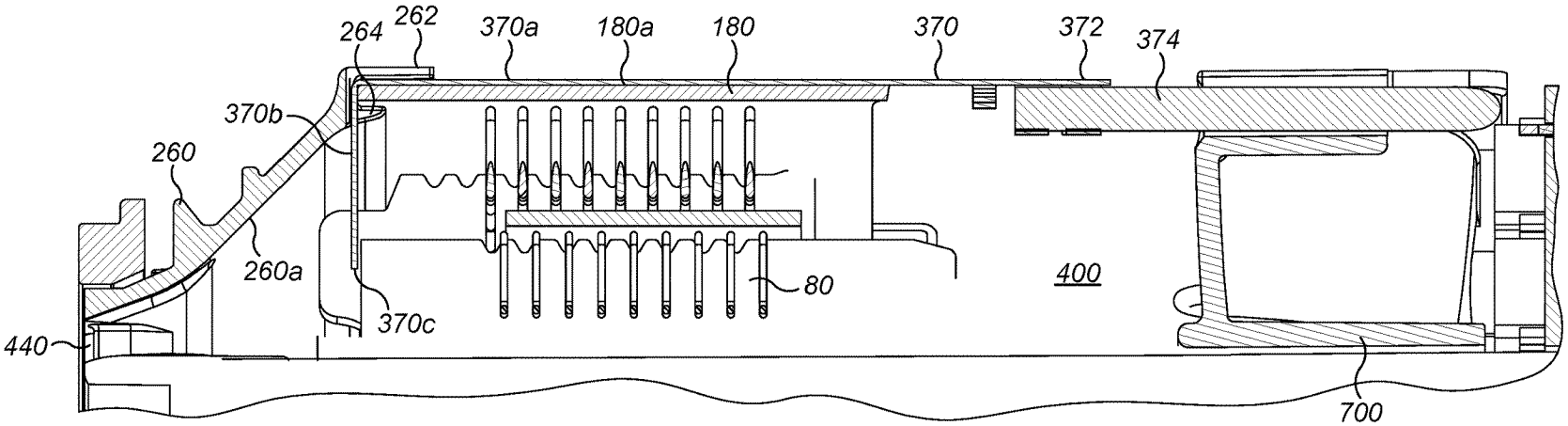
FIG. 6 shows a cross section through the body of a hairdryer showing the ioniser.

FIGS. 1 and 2 show a hairdryer 10 with a handle 20 and a body 30. The handle has a first end 22 which is connected to the body 30 and a second end 24 distal from the body 30 and which includes a primary fluid inlet 40. Power is supplied to the hairdryer 10 via a cable 50. At a distal end of the cable 50 from the hairdryer 10 a plug (not shown) is provided, the plug may provide electrical connection to mains power or to a battery pack for example.

The handle 20 has an outer wall 200 which extends from the body 30 towards a distal end 24 of the handle. At the distal end 24 of the handle an end wall 210 extends across the outer wall 200. The cable 50 enters the hairdryer through this end wall 210. The primary fluid inlet 40 in the handle 20 includes first apertures that extend around and along 42 the outer wall 200 of the handle in a series of rows and/or columns that extend from the distal end 24 of the handle 20 and second apertures that extend across 46 and through the end wall 210 of the handle 20. The cable 50 is located approximately in the middle of the end wall 210 so extends from the centre of the handle 20. The handle 20 has a longitudinal axis X-X along which the outer wall 200 extends from the body 30 towards the distal end 24.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary fluid inlet 40, a fan unit 70 is provided. The fan unit 70 includes a fan and a motor. The fan unit 70 draws fluid through the primary fluid inlet 40 towards the body 30 through a primary fluid flow path 400 that extends from the primary fluid inlet 40 and into the body 30 where the handle 20 and the body 30 are joined 90. The body 30 has a first end 32 and a second end 34, the primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non-linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the inner duct 310 towards the primary fluid outlet 440 at the second end 34 of the body 30.

An inner wall 260 extends within the outer wall 360. The inner wall 260 at least partially defines the primary fluid outlet 440 and extends from the second end 34 of the body 30 between the inner duct 310 and the outer wall 360.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the inner duct 310 which is an inner wall of the body 30 and extends within and along the body. A fluid flow path 300 extends within the inner duct 310 from the fluid inlet 320 to the fluid outlet 340. At the first end 32 of the body 30, a side wall 350 extends between the outer wall 360 and the inner duct 310. This side wall 350 at least partially defines the fluid inlet 320. The primary fluid outlet 440 is annular and surrounds the fluid flow path.

A printed circuit board (PCB) 75 including the control electronics for the hairdryer is located in the body 30 near the side wall 350 and fluid inlet 320. The PCB 75 is ring shaped and extends round the inner duct 310 between the inner duct 310 and the outer wall 360. The PCB 75 is in fluid communication with the primary fluid flow path 400. The PCB 75 extends about the fluid flow path 300 and is isolated from the fluid flow path 300 by the inner duct 310.

The PCB 75 controls parameters such as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

Downstream of the PCB 75, is the heater 80 and a PCB baffle 700 is provided between the PCB 75 and the heater 80. The PCB baffle provides thermal protection for the PCB 75 when the heater 80 switched on amongst other things.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 2, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Referring now to FIGS. 3, 4, 5 and 6, the ionising system includes an ion producing electrode 370, 374 which in this embodiment comprises a high tension wire 374 and an ionising needle 370. The ionising needle, which in this embodiment is formed from a stamped metal sheet, for example steel, is connected to the high tension wire 374 via a connector 372 and the high tension wire 374 connects to the negative ion generator 376 which, in this embodiment, is housed in the PCB baffle 700.

The ionising needle 370 extends along an external periphery of the heater 80, in particular the heater 80 includes an outer wall 180 and the ionising needle 370 extends along an outer surface 180*a* of the outer wall 180 from an upstream end 80*a* of the heater 80 to a downstream end 80*b* of the heater. At the downstream end 80*b* of the heater 80, the ionising needle 370 extends radially inwards of the outer wall 180 of the heater 80. The ionising needle 370 has two parts, a first part 370*a* which extends along the outer wall 180 of the heater 80 and a second part 370*b* which is substantially orthogonal to the first part and extends across the downstream end 80*b* of the heater 80.

At the distal end 370*c* of the ionising needle 370 from the connector 372, the ionising needle is shaped to form a point from which anion ions are emitted when the ionising system is activated. Thus ions are emitted into the fluid flow exiting the heater 80.

In order to position the ionising needle 370 properly and repeatedly within the fluid flow path 400, the ionising needle is restrained proximate to the downstream end of the first part 370*a* or where the first part 370*a* joins the second part 370*b*.

An inner wall 260 extends radially around the downstream end of the heater 80. The inner wall 260 has a pair of lips 262, 264 that extend towards the heater 80 into which the outer wall 180 of the heater 80 is inserted. A radially inner surface 260*a* of the inner wall 260 directs the fluid that exits the heater 80 towards the fluid outlet 440.

The radially outer lip 262, extends over the outer surface 180*a* of the outer wall 180 and includes a recess or cut-out 378 for accommodating the ionising needle 370. At the downstream of the recess or cut-out 378 the ionising needle 370 is bent through approximately 90° to form the second part 370*b* and extends radially inwards of the inner wall 260 across the downstream face of the heater 80 and in the fluid flow path 400. The ionising needle 370 is correctly positioned when the first part 370*a* is recessed within the recess or cut-out 378*a*.

The ionising system is additionally restrained upstream of the connector 372, where the high tension wire 374 is retained within a channel 710 provided in the PCB baffle 700. The channel 710 extends from a downstream end 700*b* of the PCB baffle 700. At the upstream end 710*a* of the channel 710, the high tension wire 374 is routed to the ion generator 376 which is electrically connected to the PCB 75.

At least one retaining post 712 is provided which retains the high tension wire 374 as it extends around the periphery of the PCB baffle 700 to the ion generator 376. This is useful during manufacture as the wire is protected when the various parts of the hairdryer are assembled.

In the embodiment described, the ionising needle is shaped to form a point from which the ions are emitted, as the skilled person will appreciate, the point may be central or formed at one side of the needle. Indeed, an alternative emitter can be used such as carbon fibres which are attached to the discharge end of the needle.

In the embodiment described, the connector is upstream of the heater, this is not essential, it is advantageous where there is little space between the heater and outer wall when a flat conductive needle is utilised as the flat conductive needle has a lower profile than a high tension wire.

The invention has been described in detail with respect to a hairdryer however, it is applicable to any appliance that draws in a fluid and directs the outflow of that fluid from the appliance.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art. In particular, the heater may be a conventional heater which is trapezoid in shape and wound around a frame formed into a cross shape.

The invention claimed is:

1. A hairdryer comprising an ionising system and a heater, wherein the ionising system comprises an ion producing electrode and the ion producing electrode has a first part which extends along a first axis and a second part substantially orthogonal to the first axis, and wherein the first part extends along an external periphery of the heater and the second part extends radially inwards from the external periphery of the heater across a flow path exiting from the heater.

2. The hairdryer of claim 1, wherein the ion producing electrode extends along the heater to a downstream end of the heater.

3. The hairdryer of claim 1, wherein the ion producing electrode extends along the heater from an upstream end of the heater.

4. The hairdryer of claim 1, wherein the heater is generally cylindrical and the ion producing electrode extends along a radially outer surface of the heater.

5. The hairdryer of claim 1, wherein the heater is surrounded by a wall and the ion producing electrode extends along an external periphery of the wall.

6. The hairdryer of claim 1, wherein the ionising system comprises an ion generator and the ion producing electrode comprises a high tension wire which extends from the ion generator.

7. The hairdryer of claim 1, wherein the ion producing electrode comprises a flat conductive needle.

8. The hairdryer of claim 1, wherein the ionising system comprises an ion generator; and the ion producing electrode comprises a high tension wire which extends from the ion generator, a flat conductive needle, and a connector for connecting the flat conductive needle to the high tension wire.

9. The hairdryer of claim 8, wherein the connector is located at or near an upstream end of the heater.

10. The hairdryer of claim 8, wherein the heater is surrounded by a wall and the connector is located at or near an upstream end of the wall.

11. The hairdryer of claim 1, further comprising an inner wall adapted to retain a downstream end of the heater in position within the hairdryer wherein the inner wall comprises a recess for accommodating the ion producing electrode.

12. The hairdryer of claim 11, wherein the inner wall comprises an aperture through which the ion producing electrode projects.

13. The hairdryer of claim 12, wherein the first part extends along the external periphery of the heater to the recess in the inner wall.

14. The hairdryer of claim 13, wherein the second part extends through the aperture radially inwards from the external periphery of the heater and inner wall.

15. The hairdryer of claim 14, wherein the first part and the second part are formed from a flat conductive needle.

16. The hairdryer of claim 13, wherein the ion producing electrode comprises a third part and the third part extends from an ion generator to the first part.

17. The hairdryer of claim 16, wherein the third part comprises a high tension wire.

* * * * *